US010625131B2

(12) United States Patent
Ohtani et al.

(10) Patent No.: US 10,625,131 B2
(45) Date of Patent: Apr. 21, 2020

(54) GAME MACHINE AND GAME SYSTEM

(71) Applicant: AXELL Inc., Tokyo (JP)

(72) Inventors: Yoshihiro Ohtani, Tokyo (JP); Ryo Watanabe, Tokyo (JP); Masahiro Okawara, Kawasaki (JP)

(73) Assignee: AXELL Inc., Tokyo (JP)

( * ) Notice: Subject to any disclaimer, the term of this patent is extended or adjusted under 35 U.S.C. 154(b) by 0 days.

(21) Appl. No.: 15/762,204

(22) PCT Filed: Dec. 20, 2016

(86) PCT No.: PCT/JP2016/087881
§ 371 (c)(1),
(2) Date: Mar. 22, 2018

(87) PCT Pub. No.: WO2017/110775
PCT Pub. Date: Jun. 29, 2017

(65) Prior Publication Data

US 2018/0272213 A1 Sep. 27, 2018

(30) Foreign Application Priority Data

Dec. 25, 2015 (JP) ..... 2015-255443

(51) Int. Cl.
*A63B 21/00* (2006.01)
*A63B 67/08* (2019.01)
(Continued)

(52) U.S. Cl.
CPC ..... *A63B 67/083* (2013.01); *A63B 43/004* (2013.01); *A63B 67/10* (2013.01);
(Continued)

(58) Field of Classification Search
CPC ..... A63B 67/08; A63B 67/083; A63B 67/10; A63B 67/12; A63B 67/16; A63B 67/20;
(Continued)

(56) References Cited

U.S. PATENT DOCUMENTS

2016/0096066 A1* 4/2016 Goldberg ..... A63B 69/00 473/513

FOREIGN PATENT DOCUMENTS

JP 8-131592 A 5/1996
JP 11-206939 A 8/1999
(Continued)

OTHER PUBLICATIONS

First Office Action dated Dec. 9, 2019, of counterpart Chinese Application No. 201680057887.5, along with an English translation.

*Primary Examiner* — Omkar A Deodhar
(74) *Attorney, Agent, or Firm* — DLA Piper LLP (US)

(57) ABSTRACT

A game machine makes it possible to make an accurate determination of not only success but also failure with regard to a predetermined play action, and can handle various play rules. The game machine includes at least one game machine main body, and at least one game machine sub unit configured to enable a play by being arranged in a predetermined position on the game machine main body, and is characterized in that, to provide an evaluation of successful play when the game machine sub unit is positioned in the predetermined position on the game machine main body, the game machine main unit and/or the game machine sub unit is provided with a position grasping unit for grasping a positional relationship of the main body and the sub unit. The position grasping unit includes a sensing device utilizing an electric change.

6 Claims, 6 Drawing Sheets

(51) Int. Cl.

| | |
|---|---|
| ***A63B 43/00*** | (2006.01) |
| ***A63B 69/00*** | (2006.01) |
| ***A63B 67/10*** | (2006.01) |
| *A63B 24/00* | (2006.01) |

(52) U.S. Cl.
CPC ..... *A63B 69/0088* (2013.01); *A63B 24/0084* (2013.01); *A63B 2209/08* (2013.01); *A63B 2220/40* (2013.01); *A63B 2220/44* (2013.01); *A63B 2220/80* (2013.01); *A63B 2220/801* (2013.01); *A63B 2220/833* (2013.01); *A63B 2225/20* (2013.01); *A63B 2225/50* (2013.01)

(58) Field of Classification Search
CPC .... A63B 67/205; A63B 67/22; A63B 2102/14
See application file for complete search history.

(56) References Cited

FOREIGN PATENT DOCUMENTS

| | | | |
|---|---|---|---|
| JP | 11-313907 | A | 11/1999 |
| JP | 2003-210854 | A | 7/2003 |
| JP | 2015-167746 | A | 9/2015 |
| WO | 2010/027015 | A1 | 3/2010 |
| WO | 2010/101970 | A2 | 9/2010 |

* cited by examiner

GAME MACHINE AND GAME SYSTEM

TECHNICAL FIELD

This disclosure relates to a game machine and a game system using the game machine. More specifically, the disclosure relates to a game system and a game system using the game machine capable of accurately determining not only whether a predetermined game play is successful, but also whether the predetermined game play is in failure, and being applicable to various game rules.

BACKGROUND

Due to the recent development of electronic devices, digital appliances are also progressing in game tools, various proposals have been made to improve entertainment by using an electric mechanism and to improve the ease of playing.

For example, Japanese Unexamined Patent Application Publication No. H08-131592 (JP H08-131592 A) discloses a bat for practice swinging, which also may be used as a game tool. In a hollow portion provided in a rod body, a movable body holding portion and a collision portion are spaced apart from and face each other in the axial direction of the rod body, and the movable body holding portion and a magnetic action freely reciprocate a detachable movable body between the movable body holding portion and the collision portion.

Also, Japanese Unexamined Patent Application Publication No. 2003-210854 (JP 2003-210854 A) discloses a light emitting spinning top including a spinning top body to which an LED element is visualizably attached. The spinning top body incorporates, in an inner space thereof, a piezoelectric element which is electrically connected to the LED element; and an independent moving body. When a braking force due to a collision of the game spinning tops with each other is applied to the spinning top body, the moving body operates independently from the spinning top body to distort the piezoelectric element.

Further, Japanese Unexamined Patent Application Publication No. 11-313907 (JP 11-313907 A) discloses a kendama game apparatus with high gaming characteristics, which is not boring. The apparatus includes: a bored ball body linked to a body of the apparatus through a string member with a predetermined length where the apparatus body includes cups and a spike for putting the ball body thereon. Each of the cups and the spike includes a light emitting unit and a detection unit to detect that the ball body is placed. A control unit is disposed within the body of a toy to control the lighting of the light emitting units based on the detection results of the detection units.

Moreover, Japanese Unexamined Patent Application Publication No. 11-206939 (JP 11-206939 A) discloses a game machine capable of recording and displaying the score of the kendama play, including: a handle as a grip portion; a recess provided at a bottom portion of the handle; a drum portion crossing the handle; recesses provided at both end portions of the drum portion; an insertion portion provided at the tip end portion of the handle; and a freely movable ball with a hole provided therein. The game machine includes the ball and the handle where proximity sensors are provided in the recesses and the insertion portion. A game circuit that receives and processes a proximity signal T from the proximity sensors is provided in the handle as the grip portion. A display unit that displays the signal processed by the game circuit as a score is provided. When a discharged and falling ball is received in one of the recesses or the insertion portion is inserted into the hole of the ball, one of the proximity sensors outputs the detection signal T. A score corresponding to the detection signal T is displayed on the display unit to allow every participant to check the score.

However, the game tools according to the proposal above have a problem in that the tools still need determination by a human being so that it is almost impossible to concentrate on the play and accurately determine whether a predetermined game play is completed. For example, in JP 11-206939 A, although the success is determined by using the proximity sensors, the configuration in JP 11-206939 A has a problem that only the cases of success are counted. That is, it cannot be determined whether the game play is in failure. Also, the configuration has a problem in that it is almost impossible to accurately determine the game skills.

In summary, the conventionally proposed game machines fail to accurately determine the success and failure of the game play. Accordingly, development of game machines that determine not only whether the game play is successful but also whether the game play is in failure and are applicable to various game rules have been needed.

It could therefore be helpful to provide a game machine that accurately determines not only whether a predetermined game play is successful, but also whether the predetermined game play is in failure and is applicable to various game rules, and a game system using the game machine.

SUMMARY

We provide a game machine including a main body and a sub unit, which game machine includes not proximity sensors but a positional relationship grasping unit which determines a positional relationship between a predetermined portion of the main body and the sub unit.

In particular, we provide:

1. A game machine comprising: at least one game machine main body and at least one game machine sub unit configured to allow a player to play a game by being arranged at a predetermined position of the game machine main body, wherein a position grasping unit is provided in at least one of the game machine main body and the game machine sub unit, which position grasping unit grasps a positional relationship between the game machine main body and the game machine sub unit so that the game play is determined as successful when the game machine sub unit is positioned at a predetermined position of the game machine main body, and the position grasping unit includes a sensing device based on an electrical change.

2. A game system including the game machine according to above 1, a terminal including a central processing unit and a recording medium, and an application stored in the terminal, the game system comprising:

a detection unit for detecting an operation of the game machine;

a transmission unit for transmitting an operation of the game machine detected by the detection unit to the terminal;

an input unit for automatically supplying information on the operation of the game machine transmitted by the transmission unit to the application; and an operation unit for causing the application to perform a predetermined operation based on the supplied information.

The game machine accurately determines not only whether a predetermined game play is successful but also whether the predetermined game play is in failure, and is applicable to various game rules.

Further, the game machine system includes the game machine, and the game play result in the game machine is transmitted in real time where the data causes the other device to perform a predetermined operation. This allows a player to not only simply enjoy the playability of the game machine but also play a game with higher entertainment.

BRIEF DESCRIPTION OF THE DRAWINGS

Features, advantages, and technical and industrial significance of examples will be described below with reference to the accompanying drawings, in which like numerals denote like elements.

DETAILED DESCRIPTION

Hereinafter, our games and systems will be described in more detail.

Entire Configuration

Figure 1:
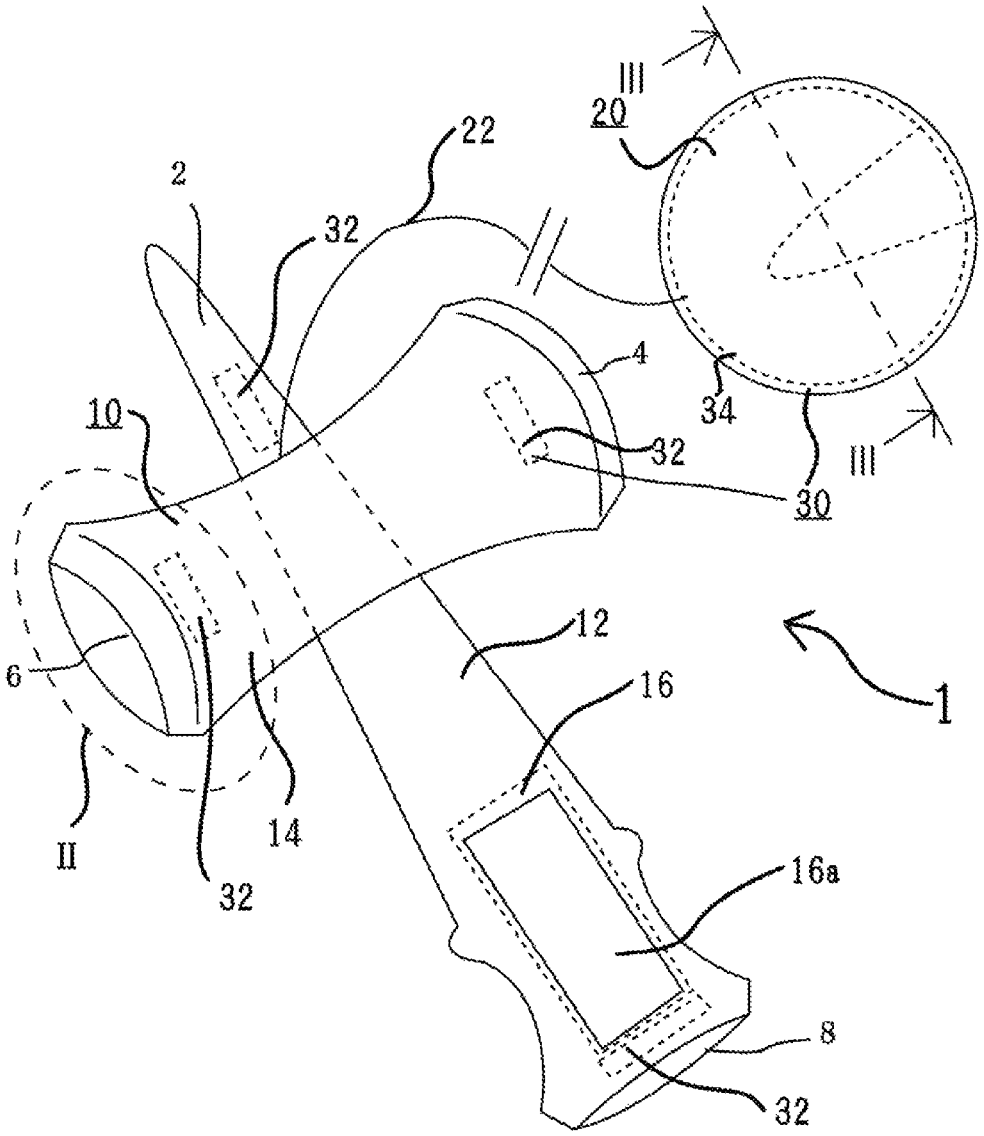
FIG. 1 is an internal transparent perspective view illustrating a kendama as an example of a game machine.

As shown in FIG. 1, the game machine is directed to a kendama 1 as a game machine including a game machine main body 10, and a ball 20 as a game machine sub unit configured to be arranged at a predetermined position of the game machine main body 10 and allow a player to play a game.

A position grasping unit 30 that grasps the positional relationship between the game machine main body 10 and the ball 20 is provided to evaluate when the ball 20 is positioned at a predetermined position of the game machine main body 10 as successful.

Details will be described below.

Game Machine Main Body

As shown in FIG. 1, the game machine main body 10 includes a handle 12 and a drum 14, and is configured in a gavel shape. The drum 14 is configured such that an intermediate portion between the end portions of the drum 14 is constricted, and a through hole is provided in the most constricted portion in a direction perpendicular to the axis of the drum 14. The tip end of the handle 12 is provided as a small conical spike. The game machine main body 10 is configured by inserting the handle 12 into the through hole from the tip end. The handle 12 and the drum 14 are hollow inside, and wiring holes for arranging wirings inside the drum 14 from the handle 12 are provided in the portion of the handle 12 located within the drum 14.

A small cup 8 is provided at the proximal end of the handle 12, and a spike 2 is provided at the tip end of the handle 12. A large cup 4 is provided at one end of the drum 14, and a medium cup 6 is provided at the other end of the drum 14. The configuration of the cups and the spike is the same as the ordinary kendama. A battery storage 16 having an openable and closable lid 16*a* is provided inside the handle 12. The battery storage 16 may store any battery such as a dry battery to be used as a power supply. The battery storage 16 is connected through wirings (not shown) to position grasping units which will be described below to supply power to the units. The handle 12 and the drum 14 are each made of a plastic material. Also, the joining portions of the handle 12 and the drum 14 are connected to each other using a fastening member such as a screw member (not specifically shown).

Ball as Game Machine Sub Unit

The ball 20 is connected through a string 22 to the handle 12. On the opposite side of the portion of the ball 20 to which the string 22 is connected, a conical hole is provided such that the spike is inserted therethrough. Further, the interior of the ball 20 may be made hollow to accommodate therein the position grasping unit which will be described below. In this example, the ball 20 is made of a plastic material, and a layer of a magnetic material such as iron is provided on the outer circumferential surface of the ball 20.

Figure 2:
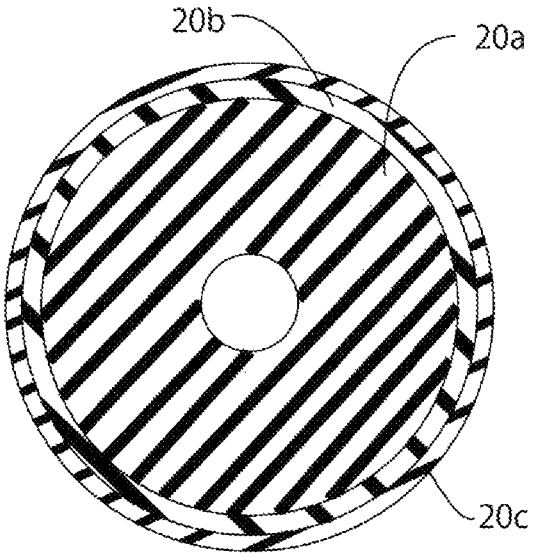
FIG. 2 is a cross-sectional view taken along line III-III in FIG. 1.

Also, when an inductor which will be described below as a position grasping unit is used, the ball 20 is preferably configured as shown in FIG. 2. That is, a central layer 20*a* made of a lightweight material such as wood, a conductive layer 20*b* on the entire outer surface of the central layer 20*a*, and a coating layer 20*c* coating the entire surface of the conductive layer 20*b* are provided. The material of the conductive layer 20*b* is preferably aluminum, titanium (such as titanium oxide), and copper, for example, since they are advantageous in terms of costs, are lightweight, and fail to be easily removed from the central layer 20*a*. The weight of the ball is important from the viewpoint of the ease of playing the game, and it is preferable to adjust the thickness of the conductive layer 20*b* to a weight that is easy to handle to play the game. The coating material configuring the coating layer as the outermost layer may be appropriately selected from coating materials commonly used for toys in consideration of the material of the conductive layer and the appearance design.

Position Grasping Unit

In this example, the position grasping unit 30 includes a sensing device based on the electrical changes.

Specifically, the following three device configurations may be applied to the position grasping unit 30.

1. A configuration including electromagnetic devices (commercially available) that measure a voltage change provided on the game machine main body 10 side and a magnetic material such as a thin iron plate provided on the entire inner surface of the ball 20;
2. A configuration including Hall sensors (commercially available products may be used) provided on the game machine main body 10 side and a magnetic material 34 such as a thin iron plate provided on the entire inner surface of the ball 20; and
3. A configuration including inductors such as a radial lead inductor may be employed. Specifically, a commercially available product such as a radial lead inductor manufactured by Taiyo Yuden Co., Ltd. may be employed. However, it is preferable that a configuration which will be described below be employed.

In any of the configurations, the position grasping unit 30 needs to be provided in each of the cups and the spike. Accordingly, in the kendama, four of the position grasping units 3 in total are provided.

When the electromagnetic device and the Hall sensor are employed as the position grasping unit 30, as the magnetic material 34 provided in the ball 20 approaches a predetermined position, an electrical change occurs in the devices, for example, the voltage changes in the electromagnetic device and the magnetic flux changes in the Hall sensor. That is, when the devices above are employed, it is preferable that the position grasping unit includes a magnetic field detection device provided in the game machine main body and a magnetic material to be detected by the magnetic field detection device provided in the sub unit.

Also, when the inductors are employed, as described above, the ball 20 is preferably configured as shown in FIG. 2. Though various sizes of inductors may be used as appropriate, it is necessary to resonate the inductor circuit with the frequency of the transmitting side. Accordingly, when the inductor is used at a position shown in FIG. 3, for example, the inductor is positioned such that the coil center of the inductor is consistent with the center of the corresponding cup, and the inductors are oriented such that the magnetic field detection direction of each inductor (the direction in which the magnetic field is detected when electricity is applied to the coil, i.e., the vertical direction of the coil with respect to the center of the coil) is perpendicular to the corresponding cup.

In any of the device configurations, the electrical changes are measured in advance. When a predetermined voltage change or magnetic flux change occurs and the change continues for a predetermined period (for example, one second), the game play is determined as successful. In contrast, if the change fails to continue for a predetermined period even if the change occurs, the game play is determined as failure. This allows the central processing unit to grasp the situation of the game play.

A preferred example where the inductor is used as the position grasping unit 30 will be further described with reference to FIGS. 4 and 5.

Figure 4:
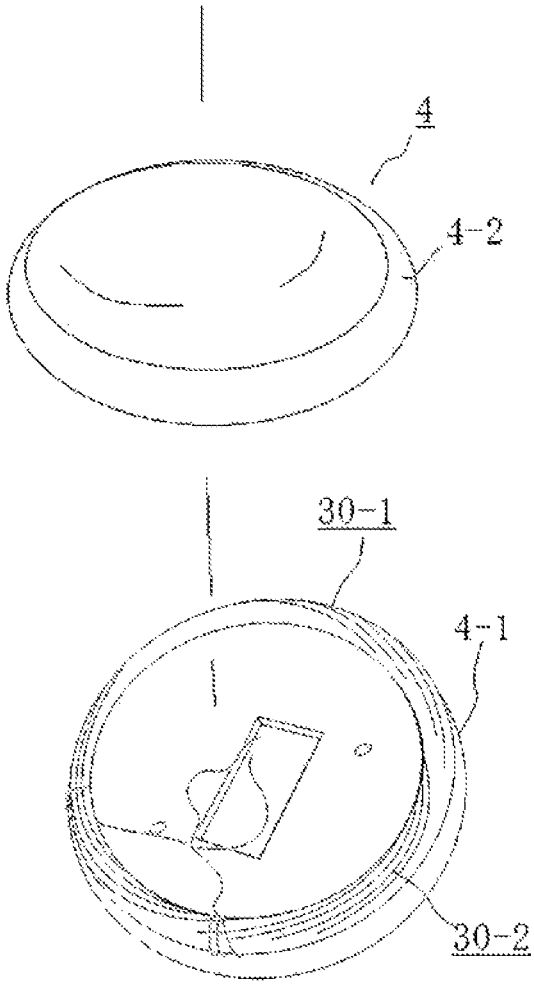
FIG. 4 is a partially enlarged view of the kendama shown in FIG. 1 illustrating an example of a position grasping unit.

FIG. 4 illustrates a configuration of the inductor as the position grasping unit provided in the cup with the large cup 4 as one example of the cup. Any of the cups is configured in the same manner. The large cup 4 shown in FIG. 4 includes a lower body 4-1 and a lid 4-2 which configures an upper surface of the cup and is freely engageable with the lower body 4-1. The inductor 30-1 includes a coil 30-2 provided in a circle along the circumference of the large cup 4 inside the large cup 4, an electricity supply device (not shown) connected to the coil to pass electric current through the coil, and a substrate (not shown) connected to the coil where a sensor and a detection circuit are provided in the substrate to detect a change in the magnetic field from the current change received by the coil. Although not specifically illustrated and described, the electricity supply device is connected to a power supply. As for the substrate, a substrate commonly used for the type of the inductors may be employed without any particular limitation.

As for the coil 30-2, there is no particular limitation on how the wires are wound, but it is preferable to set the inductance to be 10 to 50 μH. Further, the coil 30-2 is provided along the circumferential edge of the large cup 4. This allows the coil 30-2 to detect the change in the magnetic field in a wide area to accurately grasp the position of the ball 20.

Figure 5:
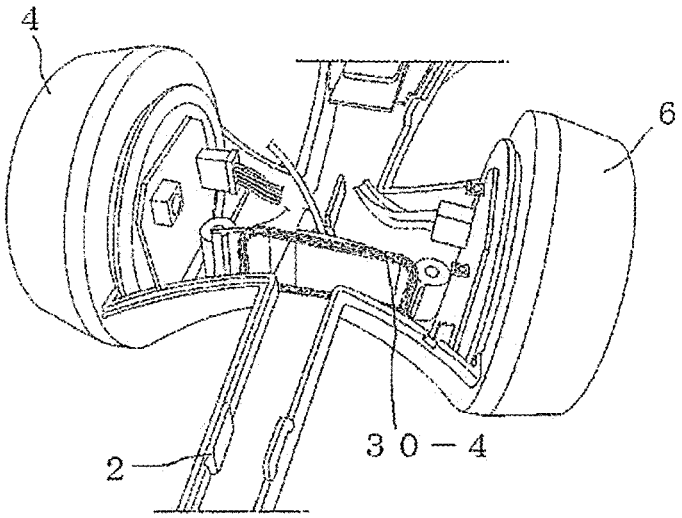
FIG. 5 is a partially enlarged view of the kendama shown in FIG. 1 illustrating another example of the position grasping unit.

Further, in the spike 2, as shown in FIG. 5, the inductor is configured such that the coil 30-4 is provided in a rectangular shape within the proximal end of the spike 2 with an area greater than that of the proximal end of the spike 2 to surround the proximal end of the spike 2. The configuration other than this point is the same as the configuration of the large cup. This allows the inductor to reliably grasp the state where the ball 20 is positioned on the spike 2.

As to the grasping of the game play situation, the case of employing an electromagnetic device will be further described below. When the electromagnetic device is employed, a pulse signal to allow the coil (not shown) configuring the electromagnet to generate a waveform corresponding to the magnitude of the inductance of the coil is supplied to the coil. Also, a signal supply and detection unit that detects the magnitude of the coil inductance by supplying the pulse signal to the coil is arranged in the electromagnetic device (not shown). The signal supply and detection unit, for example, applies the pulse signal to the coil, and detects the magnitude of coil inductance based on the waveform of the pulse current flowing through the coil by application of the pulse signal. The signal is then transmitted to the central processing unit, and the central processing unit grasps the magnitude of the inductance over time. If the magnitude of the inductance exceeds a preset threshold and the time period during which the inductance exceeds the threshold exceeds a predetermined time period, the central processing unit determines the game as successful.

Also, depending on the playing method such as performing a combo, the time exceeding the threshold may be considerably short in some cases. In such cases, since a part of the time exceeding the threshold continuously changes while moving, the cases may be set to be determined as successful in advance. The case of employing the inductors will be described below as well. When the ball 20 comes close to the position where the inductor is provided, the inductance fluctuates due to the influence of the conductor provided in the ball 20. The degree of the fluctuation is measured in advance and the fluctuation of the inductance when the conductor comes into contact with the cup or the spike is recorded. When the state of the recorded fluctuation is detected, the skill in the game play is determined as successful. The configuration such as provision of the signal supply and detection unit is the same as the configuration in the electromagnet described above.

Figure 3:
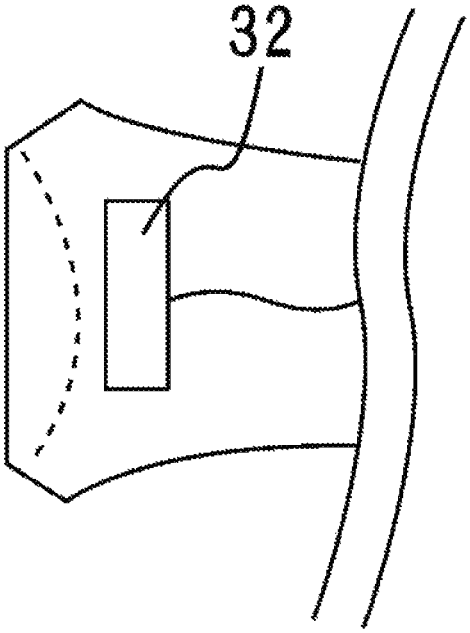
FIG. 3 is a partially enlarged view of FIG. 1.

The specific device configuration will be described below with reference to FIG. 3. The large cup includes an inductor 32 therein, which inductor 32 is connected through the wiring to the battery storage, and connected to a central processing unit and a communication unit which will be described below as well. Inside the ball 20, an iron plate as a magnetic material is arranged in a shape conforming to the entire internal shape of the ball 20. The Hall sensors and the electromagnets may be configured in the same manner as the inductors.

Figure 6:
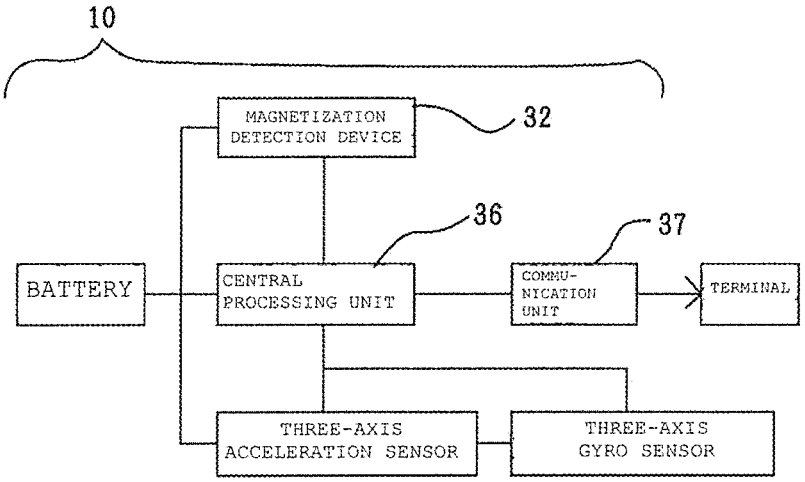
FIG. 6 is a schematic diagram illustrating a device configuration of the position grasping unit.

Further, in this example, a device configuration as shown in FIG. 6 may be employed. That is, the game machine main body 10 includes: a battery; a magnetization detection device 32 such as an electromagnetic device or a Hall sensor which receives an electric power from the battery through a wiring and senses an electrical change; a central processing unit 36 connected through a wiring to a magnetic field detection device, which central processing unit 36 receives a change in the magnetic field detected by the magnetic field detection device in real time and analyzes the change to determine whether the game play is successful or in failure;

and a communication unit 37 which transmits the situation of the game play determined by the central processing unit to other game machines and various terminals which will be described below. The arrangement positions of the central processing unit 36 and the communication unit 37 are optional as long as they are positioned within the game machine main body.

Furthermore, a body condition detector including a three-axis acceleration sensor 38 and a three-axis gyro sensor 39 that detects the posture of the kendama is provided inside the main body to determine whether the player is playing the game and which cup or spike the player intends to put the ball in. The detector is connected through a wiring to a battery storage to receive power supply and is connected to the central processing unit to transmit the detection result to the central processing unit. Each of the three-axis acceleration sensor and the three-axis gyro sensor has a built-in digital motion processor (DMP), and is configured to detect the posture angle (Euler angle) by using a known method described in WO2010/027015 and WO2010/101970. The data of the Euler angle detected by the body condition detector is then immediately transmitted to the central processing unit so that the central processing unit grasps the posture of the kendama in the state facing the vertical direction (either upward or downward, the vertical direction is directed within a range of 90°±5° with respect to the horizontal state). This allows the central processing unit to accurately grasp the posture of the kendama and accurately grasp what cup or spike the player intends to put the ball in. In this example, the body condition detector detects the posture of the game machine main body as described above, and a current switching unit is provided to allow a current to flow only through the magnetic field detection device such as an electromagnetic device corresponding to the cup in which the player intends to put the ball to save electric power. That is, the game machine is configured such that a switching device capable of turning on and off the current is disposed between the battery and each of the magnetic field detection devices provided in the cups or spike, and as described above, the posture of the kendama is grasped and the switching device corresponding to only the cup or the spike in which the player intends to put the ball is turned on so that the current passes through only the magnetic field detection device of the target cup or the spike.

The current switching unit is used, and the posture of the kendama is grasped and the cup or the spike in which the player intends to put the ball is grasped without switching the current so that the cup or the spike that is a target of the skill and the cup or the spike that is not a target of the skill are determined. This allows, when the inductors are employed, the central processing unit to determine whether or not it is necessary to measure the change of inductance at the place, further improving the detection accuracy. Also, depending on the type of skills such as combos, the ball may be put only for a very short time in the cup or the spike. Even in such a case, the use of the data from the body condition detector including the three-axis acceleration sensor 38 and the three-axis gyro sensor 39 allows the technique to be accurately detected.

The skills may also be detected by grasping the posture of the kendama using the current switching unit or the gyro sensor, and detecting the cup or spike in which the ball is put. The detected data may be transmitted to another device connected electrically or communicatively to determine the skill.

Operational Advantages

In the kendama 1 as a game machine, a battery such as a dry battery is stored in the battery storage to reserve the power supply to be used.

In use, the game machine main body is then operated to arrange the ball 20 at a desired position among the playing target portions including the large cup, the medium cup, the small cup, and the spike. The body condition detector then determines the orientation of the game machine main body. When the detector determines that the game machine main body is oriented upward, that is, within a range of ±45° with respect to the vertical direction, the game target portion is determined as a game target, and the current switching device passes current through the magnetic field detection device disposed at the game target portion. When the ball of the magnetic field detection device through which the current passes approaches, a change in the magnetic field occurs. The change in the magnetic field is detected, and the detected data is transmitted to the central processing unit. When the detected data falls within a preset range, the central processing unit determines that the ball is positioned in a state where the game is successful. The central unit further determines that the game is successful when the ball continues to be in the state for a predetermined period of time or when a predetermined operation is determined to be performed. The determination data is transmitted to a terminal or another game machine described below using the communication unit.

Also, two or more game machines may be connected through a communication unit, and configured to allow the processing unit to process the communication game system. In this case, for example, the two game machines are electrically or communicatively connected to each other. If a skill is successful in one of the kendamas, the information is sent to the other kendama to cause the ball of the other kendama to be hard to be removed to interfere with the game on the other kendama, improving the match game performance.

Game System

Next, the game system will be described.

The game system of this example includes the game machine above, the terminal including the central processing unit and the recording medium, and the application stored in the terminal.

The game system further includes the game machine, the detection unit that detects operation of the game machine, a transmission unit that transmits the operation of the game machine detected by the detection unit to the terminal, an input unit that automatically supplies information of the operation of the game machine transmitted by the transmission unit into the application; and an operation unit that causes the application to perform a predetermined operation based on the supplied information.

In this example, the detection unit includes the position grasping unit, the body condition detector, and the central processing unit above, and the transmission unit includes the communication unit above. Also, the terminal stores the input unit and the operation unit.

Figure 7:
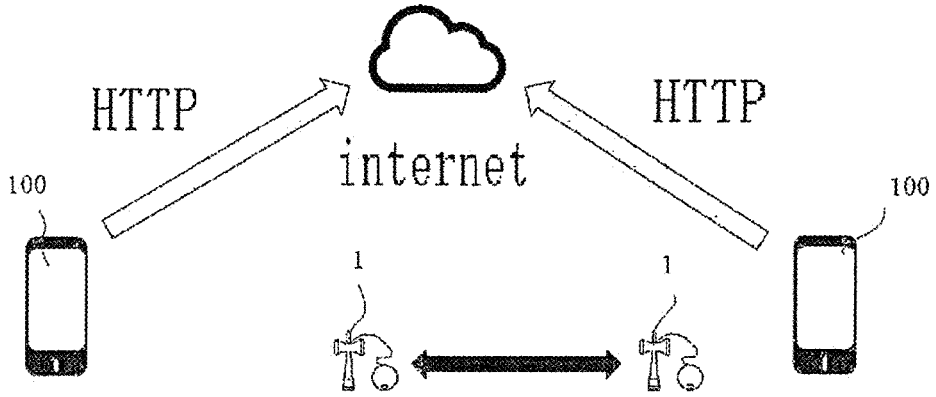
FIG. 7 is a schematic diagram illustrating an outline of a game system according to an example.

Referring to FIG. 7, the configuration of the system will be described below. The game machine 1 and the terminal 100 are connected by the communication function, allowing the connection to the Internet (HTTP) through the terminal 100, and communication with the terminal connected to the other game machine by the communication function.

Terminal

The terminal that can be used is not particularly limited as long as it has a communication function and can be connected to the Internet. A portable terminal such as a smartphone and a tablet, or a personal computer may be used as the terminal.

Application

Next, the application will be described with reference to FIGS. 8 and 9.

The application is stored in the terminal, operates on the screen on the terminal, and is linked with the game machine to obtain information from the game machine to perform a predetermined operation. Further, after the application causes the predetermined operation to be performed on the terminal, the application may issue an instruction to the game machine to increase the electromagnetic output from the electromagnetic device, causing the ball to be hard to be removed.

Such an application is stored in the storage medium in the terminal and executed by the central processing unit. As shown in FIG. 8, the application includes:

a user information input unit A through which the user inputs predetermined information;

a pairing unit B that pairs the game machine with the terminal;

an information distribution unit C that transfers instructions from the application to the paired game machine to prompt the player to execute the instructions, and transfers game information on the success or failure of the game play in the game machine to the application;

a command execution unit D that executes commands on the application according to the game play information; and a screen display unit E that displays various types of information on the screen.

Figure 9:
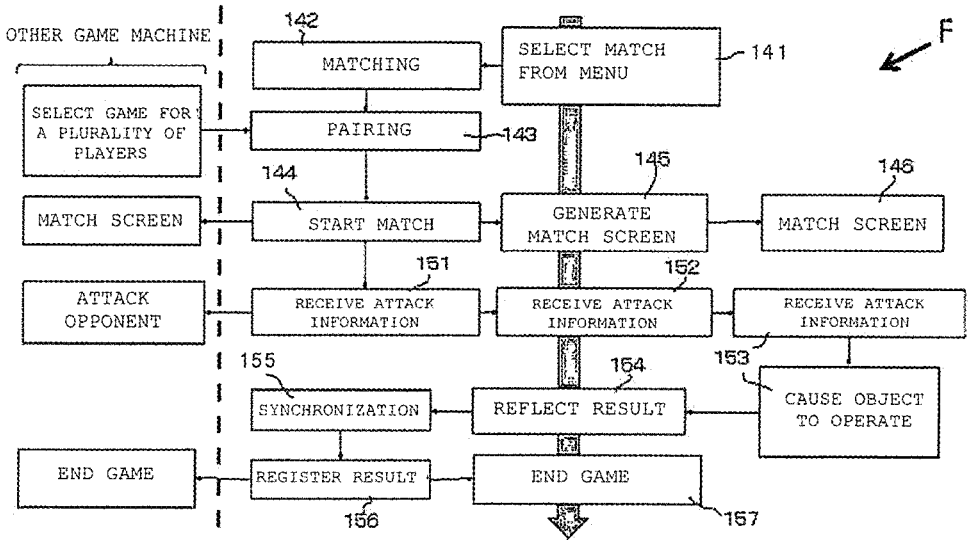
FIG. 9 is a schematic diagram (flow sheet) illustrating a flow at the time of a match in the game system according to the example.

Also, as shown in FIG. 9, in communicating with the terminal linked with the game machine of another player and playing a match with each other, in addition to the units described above, the application further includes an information exchanging unit that connects to the Internet and exchanges information by communicating with a desired opponent as the other player; and a fighting unit F that plays a match based on the information of the other player obtained through the information exchange.

This will be described below in details.

The screen display unit F may display the user information input screen, the terminal information, the opponent and candidate information, and a game screen on the application on the screen of the terminal.

In the user information input unit A, the user inputs predetermined information such as information on the user and information on the game machine to be paired to store the information in the recording medium so that the information may be appropriately used when the information is needed in the application.

The pairing unit B detects the communication function of the game machine near the terminal and starts communication with the game machine.

The information distribution unit D transfers the instructions from the application to the game machine and displays the information to be executed on the terminal screen by the screen display unit to prompt the player to play the game. Next, the game play information on the success or failure of the game play in the paired game machine is transferred through the communication unit to the terminal, and the application receives the game play information.

The command execution unit executes a command on the application according to the information such as whether or not the game is successful by the operation of the game machine, and to what degree of difficulty the skill is successful. Various commands are set depending on the type of the games in the application. For example, if the game is directed to a role-playing game, the commands may be set such that the mission is advanced according to the points of skills succeeded in the game machine at the mission execution. This improves the entertainment greater than when the game is played on the game machine alone.

For example, in a role playing game such as a growing game, commands may be set such that the degree of growth is changed according to the number of skills succeeded in the game machine and the difficulty level of the skill in growing a character. Also, in a fighting game, the commands may be set such that the damages on the opponent may be changed according to the number of skills succeeded in the game machine, and the difficulty.

As shown in FIG. 9, when a match is selected from the menu of the terminal, the fighting unit F connects to the Internet through the communication unit and performs a matching to find an opponent. When the opponent is found, the fighting unit F performs pairing with the opponent to start the game. The attack information is received to each other so that the attack result determines the winner of the game, and the result is notified to the terminals of the involved players, and reflected.

Operational Advantage

Figure 8:
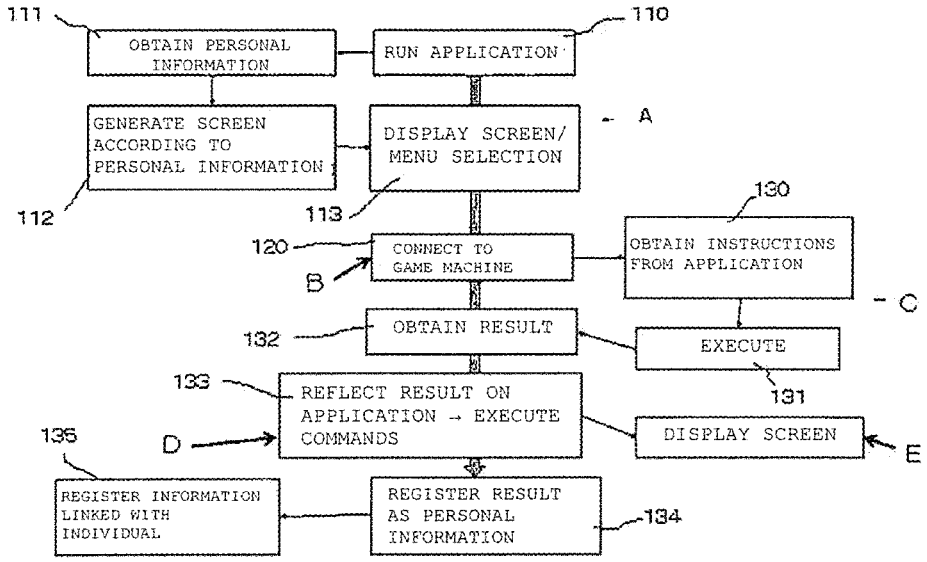
FIG. 8 is a schematic diagram (flow sheet) illustrating a flow of the game system according to the example.

Referring to FIGS. 8 and 9, the flow of the processes of the application in the actual game match will be described. First, as shown in FIG. 8, the application is run (110). This obtains preset personal information of the user from the recording medium (111), a screen corresponding to the personal information is generated (112) and displayed (113). The pairing unit B then pairs with the game machine (120) to connect with the game machine. In the game machine, the information distribution unit C obtains the instructions from the application (130), allowing the player to play the game in the state in which the game machine is linked with the terminal.

Some commands are then sent from the application to the game machine so that the game machine obtains the instructions of the application (130). This is executed by the player, and the game machine transmits the result to the terminal (131). The application obtains the transmitted game play result (132) and reflects it (133). Here, for example, if the game of the application is a role-playing game, the mission is performed according to the game play situation. The results are registered as personal information (134), and the game play information is registered based on the individual (135).

As shown in FIG. 9, the match game according to this example is set so that the match game is selected by selecting the match from the menu in the application (141). If the player selects the match, the player needs to match with the opponent. Accordingly, the player waits for matching first (142). When the opponent is found, pairing is performed with the opponent so that the information of the player and the opponent is exchanged with each other (143), and the match starts (144). In the match, first, a match screen is generated (145), and the match screen is displayed (146).

The attack information is received from the game machine of the opponent (151), the attack information in its own game machine is obtained (152), and various commands of the application are executed based on the attack information of the player and the opponent, and the game machines are affected depending on the match situation (for example, if the player is being defeated in the game, the disadvantageous condition settings are transmitted to the game machine and the game machine is controlled according to the information) (153). The situation of the game machine (information on the success or failure of the skill) is then reflected on the application (154), the match situation is synchronized to reflect the real-time game situation all the time (155), the match result is further registered (156), and the game is ended (157). Specifically, for the match, for example, the game system is set such that icons imitating the player and the opponent are displayed on the screen, a score is set for each of the skills in advance, and one icon attacks the other icon according to the score of the skill performed, causing the other icon to receive damages according to the score. The icon that gives more damages to the opponent earlier such that the amount of the damage reaches a predetermined amount is set as a winner.

Although not specifically described, the same system will also proceed in the other game machine.

This disclosure is not limited to the examples above, and various modifications may be made without departing from the spirit of the disclosure.

For example, the kendama with the single game machine main body and the single game machine sub unit is described by way of example, but the game machine may include a plurality of main bodies and sub units as quoits.

Although the handle 12 and the drum 14 are described as being made of plastic materials respectively, the material of the game machine is not particularly limited, and various materials may be used for the game machine main body and the ball as the game machine sub unit, for example, the game machine main body may be configured by wood such as synthetic wood configured by combining wood and plastics, and the ball as the game machine sub unit may be configured by applying paint containing iron powder to wood.

The magnetic material need not be provided on the entire inner surface of the ball 20 and may be appropriately provided at a portion in which the material is needed.

What is claimed is:

1. A game machine comprising:

at least one game machine main body and at least one game machine sub unit configured to allow a user to play a game by being arranged at a predetermined position of the game machine main body, wherein a position grasping unit is provided in the game machine main body and the game machine sub unit, which position grasping unit grasps a positional relationship between the game machine main body and the game machine sub unit so that a game play is determined as successful when the game machine sub unit is positioned at a predetermined position of the game machine main body, the game is a kendama, the game machine sub unit is a ball, and the game machine main body includes cups and a spike, and the position grasping unit includes inductors provided in both the cups and the spike, and a conductive layer provided on the entire outer surface of the ball, as a sensing device based on an electrical change.

2. The game machine according to claim 1, further comprising a central processing unit which determines whether the game play is successful based on a degree of a fluctuation of an inductance by the conductive layer provided on the surface of the ball when the inductor comes into contact with the ball.

3. The game machine according to claim 2, further comprising a body condition detector including a three-axis acceleration sensor and a three-axis gyro sensor for detecting a posture of the kendama, and the body condition detector transmits detected data to the central processing unit.

4. A game system comprising:

the game machine according to claim 1;

a terminal including a central processing unit and a recording medium, and an application stored in the terminal;

a detection unit that detects an operation of the game machine;

a transmission unit that transmits operation of the game machine detected by the detection unit to the terminal;

an input unit that automatically supplies information of the operation of the game machine transmitted by the transmission unit into the application; and an operation unit that causes the application to perform a predetermined operation based on the supplied information.

5. A game system comprising:

the game machine according to claim 2;

a terminal including a central processing unit and a recording medium, and an application stored in the terminal;

a detection unit that detects an operation of the game machine;

a transmission unit that transmits operation of the game machine detected by the detection unit to the terminal;

an input unit that automatically supplies information of the operation of the game machine transmitted by the transmission unit into the application; and an operation unit that causes the application to perform a predetermined operation based on the supplied information.

6. A game system comprising:

the game machine according to claim 3;

a terminal including a central processing unit and a recording medium, and an application stored in the terminal;

a detection unit that detects an operation of the game machine;

a transmission unit that transmits operation of the game machine detected by the detection unit to the terminal;

an input unit that automatically supplies information of the operation of the game machine transmitted by the transmission unit into the application; and an operation unit that causes the application to perform a predetermined operation based on the supplied information.

* * * * *